US008155541B2

(12) United States Patent
Iwamoto

(10) Patent No.: US 8,155,541 B2
(45) Date of Patent: Apr. 10, 2012

(54) FIXING DEVICE WHICH DETECTS ANOMALY OF HEATER

(75) Inventor: Satoshi Iwamoto, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 184 days.

(21) Appl. No.: 12/752,711

(22) Filed: Apr. 1, 2010

(65) Prior Publication Data

US 2010/0260508 A1 Oct. 14, 2010

Related U.S. Application Data

(60) Provisional application No. 61/167,798, filed on Apr. 8, 2009.

(51) Int. Cl.
*G03G 15/20* (2006.01)

(52) U.S. Cl. ..... 399/33

(58) Field of Classification Search ..... 399/33, 399/44, 67, 69, 94, 122, 320, 327, 400; 347/156
See application file for complete search history.

(56) References Cited

U.S. PATENT DOCUMENTS 5,497,218 A * 3/1996 Amico ..... 399/69
6,321,046 B1 * 11/2001 Kikuchi et al. ..... 399/69
7,215,919 B2 * 5/2007 Kinouchi et al. ..... 399/334
2004/0126124 A1 * 7/2004 Inoue et al. ..... 399/44
2005/0117923 A1 * 6/2005 Sasamoto et al. ..... 399/45
2005/0276625 A1 * 12/2005 Cho ..... 399/69
2006/0291883 A1 * 12/2006 Chae ..... 399/69
2007/0242970 A1 * 10/2007 Fujino ..... 399/69
2008/0008488 A1 * 1/2008 Kaji et al. ..... 399/67
2008/0292348 A1 11/2008 Furuyama
2009/0257770 A1 * 10/2009 Miyazaki ..... 399/69
2009/0324272 A1 * 12/2009 Barton et al. ..... 399/69
2010/0073417 A1 * 3/2010 Li et al. ..... 347/17

FOREIGN PATENT DOCUMENTS

JP 2002-184554 A 6/2002
JP 2004-325742 A 11/2004
JP 2005-172911 A 6/2005

* cited by examiner

*Primary Examiner* — Kiho Kim
(74) *Attorney, Agent, or Firm* — Patterson & Sheridan, LLP

(57) ABSTRACT

A fixing device shifts to the anomaly detection mode in arbitrary timing except during printing. In the anomaly detection mode, a first heat generation member and a second heat generation member are off and only a third heat generation member is turned on for a predetermined time. A quantity of temperature change in a fixing member during that time is detected by a first temperature detection member or a second temperature detection member. When the quantity of temperature change is within a predetermined range, it is determined that the third heat generation member is normal. In inspecting whether the third heat generation member is normal or not, when the temperature of the fixing member is in the area exceeding T1° C. where the temperature rise gradient of the fixing member is gentler, the inspection is skipped.

19 Claims, 7 Drawing Sheets

| RANGE OF TEMPERATURE RISE CHARACTERISTIC | MINIMUM QUANTITY OF CHANGE T2(°C) | MAXIMUM QUANTITY OF CHANGE T3(°C) |
|---|---|---|
| 160(°C) TO OFF-TEMPERATURE ($\gamma$3) | 5(°C) | 35(°C) |
| 100(°C) TO LOWER THAN 160(°C) ($\gamma$2) | 10(°C) | 40(°C) |
| ROOM TEMPERATURE TO LOWER THAN 100(°C) ($\gamma$1) | 5(°C) | 35(°C) |

FIXING DEVICE WHICH DETECTS ANOMALY OF HEATER

CROSS-REFERENCE TO RELATED APPLICATION

This application is based upon and claims the benefit of priority from Provisional U.S. Application 61/167798 filed on Apr. 8, 2009, the entire contents of which are incorporated herein by reference.

TECHNICAL FIELD

The present invention relates to a fixing device which is used in an image forming apparatus such as a copier or MFP (multi-functional peripheral) and detects anomaly of a heater.

BACKGROUND

There is a fixing device of an image forming apparatus which heats a heat roller using plural heaters with different light distribution peaks. In such a fixing device, temperature detectors arranged at the light distribution peak positions of the respective heaters detect the temperature of the heat roller and the temperature of the heat roller is thus controlled. Also, conventionally, anomaly of each heater is detected on the basis of the result of temperature detection acquired at the time of temperature control of the heat roller during printing. JP-A-2002-184554 is known as disclosing a technique of detecting anomaly of plural heaters.

However, in a fixing device which has an auxiliary heater to heat a heat roller over its whole length in addition to plural heaters with different light distribution peaks, anomaly of the auxiliary heater cannot be detected using the result of temperature detection acquired at the time of temperature control of the heater roller. Therefore, there is a risk that a delay in noticing the anomaly of the auxiliary heater may impair the proper fixing capability of the fixing device.

Thus, it is demanded that a fixing device which detects anomaly of a heater to enable early detection of anomaly of an auxiliary heater, maintenance of proper fixing capability of the fixing device and hence enhancement of productivity of an image forming apparatus should be developed.

SUMMARY

According to an embodiment, a fixing device includes: a fixing member which fixes a developer image to a recording medium; a first heat generation member which heats the fixing member; a second heat generation member which has a different heat generation peak position from a heat generation peak of the first heat generation member in a direction of a rotation axis of the fixing member and heats the fixing member; a third heat generation member which heats the fixing member overlap for the heat generation peak positions of the first heat generation member and the second heat generation member; a first temperature detection member provided near the heat generation peak position of the first heat generation member; a second temperature detection member provided near the heat generation peak position of the second heat generation member; a circuit member which performs on-off control of the first heat generation member, the second heat generation member and the third heat generation member; and an anomaly detection member which turns off the first heat generation member and the second heat generation member, turns on only the third heat generation member for a third predetermined time, detects a quantity of temperature change in the fixing member during a lapse of the third predetermined time after only the third heat generation member starts being on, by using the first temperature detection member or the second temperature detection member, and inspects whether the quantity of temperature change is within a third predetermined range or not.

DETAILED DESCRIPTION

Figure 1:
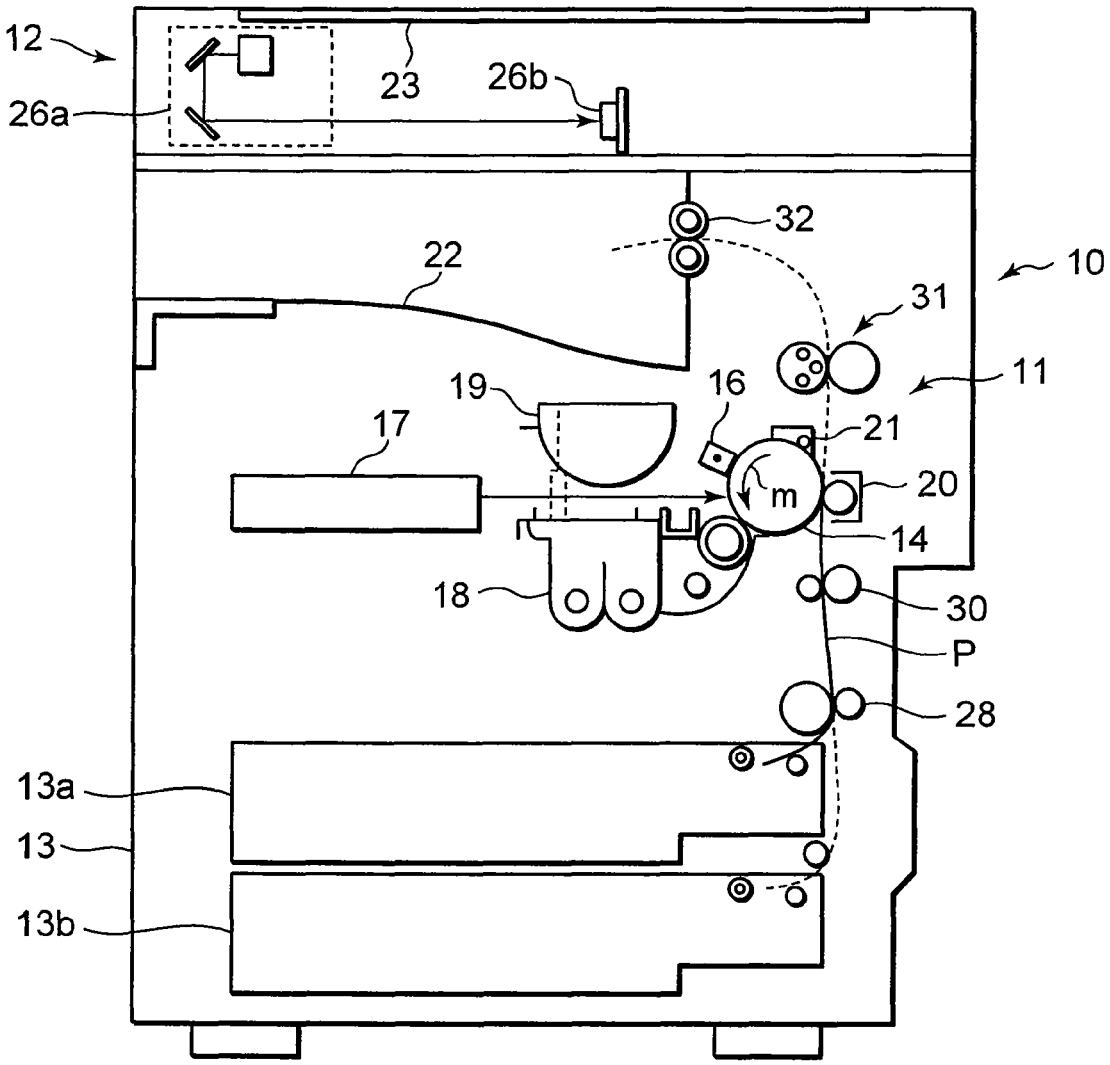
FIG. 1 is a schematic view of configuration showing a copier according to an embodiment.

Hereinafter, an embodiment will be described. FIG. 1 is a schematic view of configuration showing a copier 10 as an image forming apparatus equipped with a fixing device 31 according to the embodiment. The copier 10 has a printer unit 11, a scanner unit 12, and a paper supply unit 13.

The printer unit 11 has a charging device 16 which uniformly charges a photoconductive drum 14 as an image carrier member rotating in the direction of an arrow m, and a laser exposure device 17 which casts a laser beam based on image data or the like from the scanner unit 12 to the charged photoconductive drum 14 and thus forms an electrostatic latent image on the photoconductive drum 14. The printer unit 11 has a developing device 18 which supplies a toner to the electrostatic latent image on the photoconductive drum 14, a toner supply device 19 which supplies the toner to the developing device 18, a transfer roller 20 as a transfer member which transfers the toner image formed on the photoconductive drum 14 to a sheet P as a recording medium, and a cleaner 21. The charging device 16, the laser exposure device 17 and the developing device 18 constitute an image forming member.

The scanner unit 12 has an optical mechanism 26*a* which optically scans an original on an original table 23, and a charge coupled device 26*b* which converts an optical signal from the optical mechanism 26*a* to an electrical signal.

The paper supply unit 13 has first and second paper supply cassettes 13*a* and 13*b*. The copier 10 has, between the paper supply unit 13 and the photoconductive drum 14, a carrying mechanism 28 and a registration roller pair 30 which carries the sheet P between the photoconductive drum 14 and the transfer roller 20 synchronously with the toner image on the photoconductive drum 14. The copier 10 has a paper discharge unit 22 in a hollow body. Between the photoconductive drum 14 and the paper discharge unit 22, the fixing device 31 and a paper discharge roller 32 to discharge the post-fixing sheet P to the paper discharge unit 22 are provided.

As printing is started, in the copier 10, the charging device 16 charges the photoconductive drum 14, and then the laser exposure device 17 casts a laser beam to the photoconductive drum 14 and thus forms an electrostatic latent image corresponding to the laser beam on the photoconductive drum 14. The developing device 18 provides a toner for the electrostatic latent image on the photoconductive drum 14 and thus forms a toner image. The transfer roller 20 transfers the toner image on the photoconductive drum 14 to the sheet P passing between the photoconductive drum 14 and the transfer roller 20.

Figure 2:
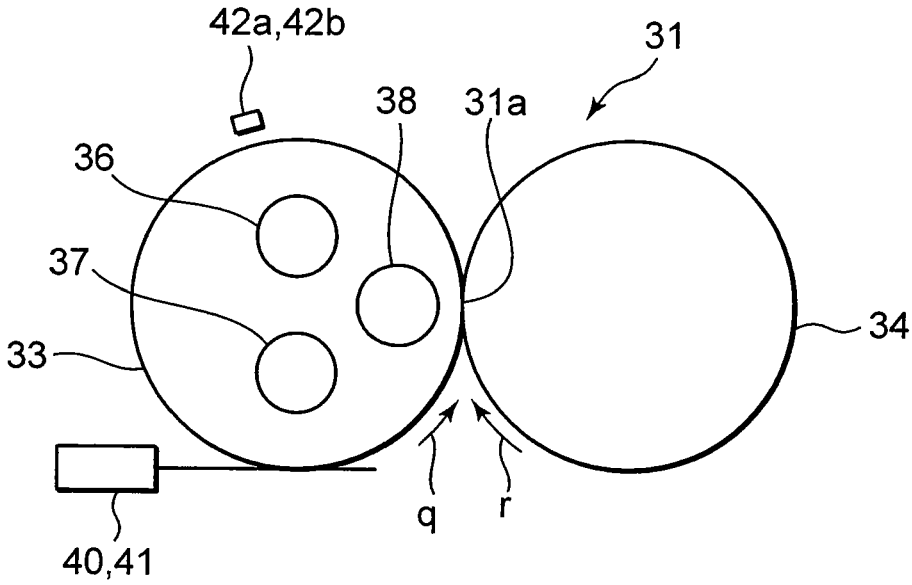
FIG. 2 is a schematic view of configuration showing a fixing device according the embodiment.
Figure 3:
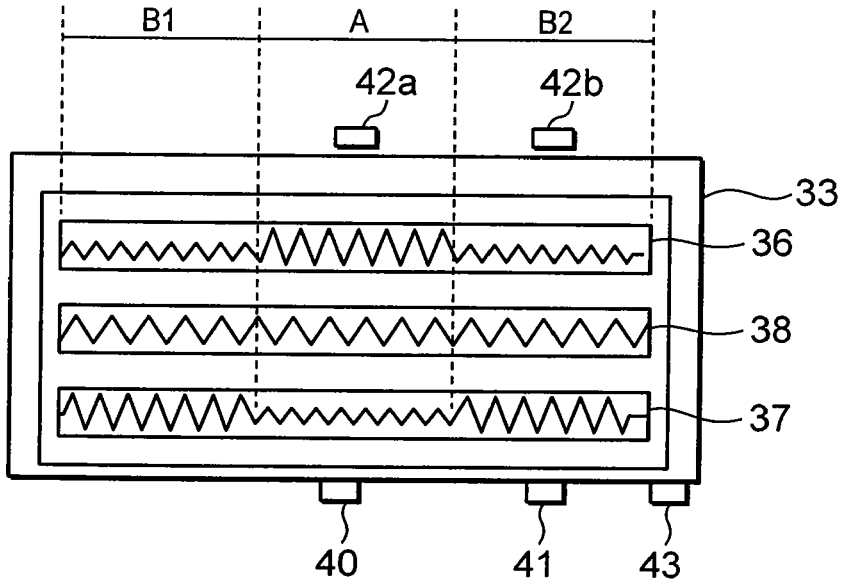
FIG. 3 is a schematic explanatory view showing a heat roller according to the embodiment.

The fixing device 31 fixes the toner image to the sheet P by heating and pressurizing the toner image while the sheet P having the toner image is nipped and carried. After the toner image is fixed, the paper discharge roller 32 discharges the sheet P to the paper discharge unit 22. The fixing device 31 has a heat roller 33 and a press roller 34 as fixing members, as shown in FIG. 2 and FIG. 3. The heat roller 33 has a surface layer of a fluorine resin or the like, for example, around a 0.8-mm thick aluminum roller. The press roller 34 has an elastic surface layer of a silicone rubber or the like, for example, on an iron roller. The heat roller 33 and the press roller 34 press in contact with each other and thus form a nip 31*a*. In the fixing device 31, the heat roller 33 and the press roller 34 nip and carry the sheet P and the toner image is fixed by being heated and pressurized.

The heat roller 33 has, in its hollow inside, a center lamp 36 with power consumption of 600 W as a first heat generation member, a side lamp 37 with power consumption of 600 W as a second heat generation member, and an auxiliary lamp 38 with power consumption of 300 W as a third heat generation member.

The center lamp 36 has a light distribution peak in a center area (A) in the axial direction of the heat roller 33. The side lamp 37 has light distribution peaks in side areas (B1) and (B2) on both sides of the center area (A) in the axial direction of the heat roller 33. The auxiliary lamp 38 has a light distribution area covering the center area (A) and the side areas (B1) and (B2) of the heat roller.

The center area (A) is, for example, longer than the 148-mm wide JIS standard A5-R size and shorter than the 210-mm wide JIS-standard A4-R size. The sides areas (B1) and (B2) together with the center area (A), for example, cover the 297-mm wide JIS-standard A3 size.

A center thermistor 40 as a first temperature detection member faces the heat roller 33 substantially at the center of the center area (A). A side thermistor 41 as a second temperature detection member faces the heat roller 33 substantially at the center of the one side area (B1). Moreover, bimetal non-contact thermostats 42*a* and 42*b* face the heat roller 33. If the thermostats 42*a* and 42*b* detect anomaly as the temperature of the bimetal exceeds, for example, 195° C., the thermostats 42*a* and 42*b* forcedly disconnect wirings that supply power to the center lamp 36, the side lamp 37 and the auxiliary lamp 38, and thus turn off the power supply. An edge thermistor 43 faces an edge of the heat roller 33.

Figure 4:
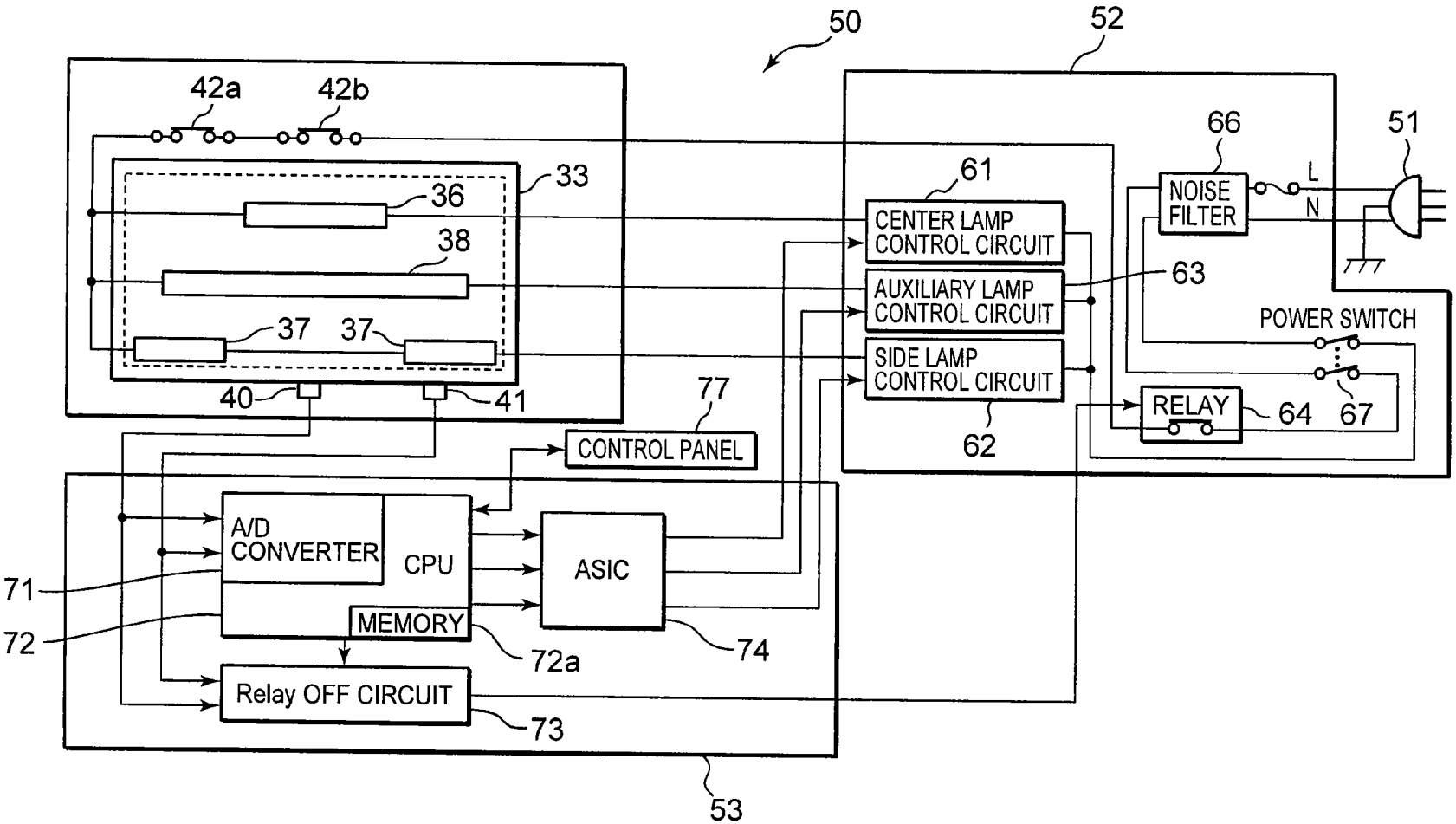
FIG. 4 is a schematic block diagram showing a control system of the heater roller according to the embodiment.

As shown in FIG. 4, a control system 50 which performs temperature control and anomaly detection of the heat roller 33 has a switching circuit 52 as a circuit member which performs on-off control of power supply from a power source 51 to the center lamp 36, the side lamp 37 and the auxiliary lamp 38. The control system 50 has a heater control board 53 which feeds back the control based on the result of detection by the center thermistor 40, the side thermistor 41 and the edge thermistor 43 to the switching circuit 52.

The switching circuit 52 is a circuit member and has a center lamp control circuit 61, a side lamp control circuit 62 and an auxiliary lamp control circuit 63 which perform on-off control of the center lamp 36, the side lamp 37 and the auxiliary lamp 38, respectively. In the switching circuit 52, the center lamp control circuit 61, the side lamp control circuit 62 and the auxiliary lamp control circuit 63 are connected to the power source 51 via a relay 64, the noise filter 66 and a power switch 67.

The heater control board 53 has an A/D converter 71, a CPU 72, a relay off circuit 73, and an ASIC 74 for the center lamp control circuit 61, the side lamp control circuit 62 and the auxiliary lamp control circuit 63. The CPU 72 is an anomaly detection member. The CPU 72 controls the entire copier 10 and controls a control panel 77 of the copier 10.

Next, temperature control and anomaly detection control of the heat roller 33 by the control system 50 will be described. As the power switch 67 is turned on, the fixing device 31 completes a startup mode in which a program is extracted or the operating system is started, and then starts a warm-up mode. In the warm-up mode, the press roller 34 follows the rotation of the heat roller 33 in the direction of arrow q and is thus driven to rotate in the direction of arrow r. The ASIC 74 turns on the center lamp control circuit 61, the side lamp control circuit 62 and the auxiliary lamp control circuit 63 to supply power to the center lamp 36, the side lamp 37 and the auxiliary lamp 38, respectively. As power is supplied to the auxiliary lamp 38 as well as the center lamp 36 and the side lamp 37, the completion of warm-up of the fixing device 31 is moved up to earlier timing.

Figure 5:
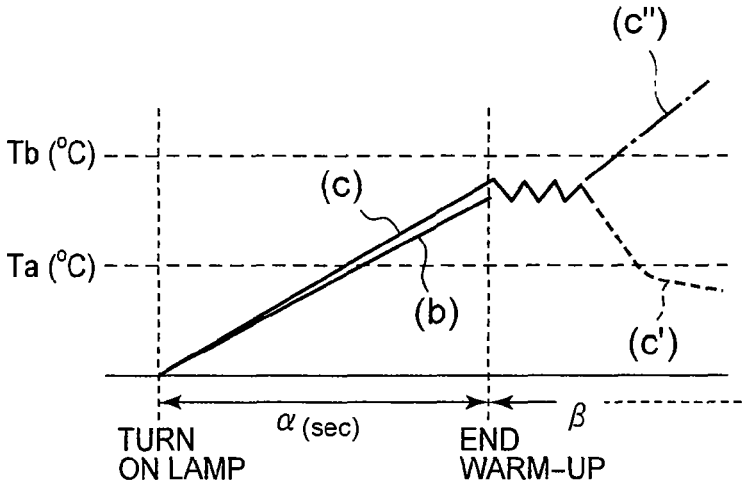
FIG. 5 is a graph showing temperature characteristics of the heat roller at a time of warm-up according to the embodiment.

FIG. 5 shows the temperature characteristics of the heater roller 33 when power is supplied to the center lamp 36, the side lamp 37 and the auxiliary lamp 38 which are all in a normal condition. As a predetermined warm-up time (for example, 20 seconds) indicated by $\alpha$ as a first predetermined time elapses, the detected temperature of the heat roller 33 by the center thermistor 40 and the side thermistor 41 reaches a predetermined fixing-enabled temperature (for example, 185° C.). (c) indicates the detected temperature by the center thermistor 40 and (b) indicates the detected temperature by the side thermistor 41.

After the detected temperature of the heat roller 33 reaches the fixing-enabled temperature, the CPU 72 shifts the fixing device 31 to a ready mode. While the fixing device 31 is in the ready mode as indicated by $\beta$, the ASIC 74 performs on-off control of the center lamp control circuit 61 and the side lamp control circuit 62 in accordance with the result of the detection by the center thermistor 40 and the side thermistor 41 and thus maintains the heat roller 33 at the fixing-enabled temperature. The ASIC 74 turns off the power supply to the center lamp 36 and the side lamp 37 when the center lamp control circuit 61 and the side lamp control circuit 62 rise to an off-temperature. The ASIC 74 turns on the power supply to the center lamp 36 and the side lamp 37 when the center lamp control circuit 61 and the side lamp control circuit 62 fall to an on-temperature. After the heat roller 33 reaches the fixing-enabled temperature, the ASIC 74 performs on-off control of the auxiliary lamp control circuit 63 according to needs.

The ASIC 74 turns on the power supply to the auxiliary lamp 38 to supplement the quantity of heat of the center lamp 36 and the side lamp 37 when this operation is necessary in order to maintain the heat roller 33 at the fixing-enabled temperature.

The heat roller 33 may shift to a sleep mode when fixing does not take place within a predetermined time while the fixing-enabled temperature is maintained. In the sleep mode, for example, the heat roller 33 is maintained at a lower temperature than the fixing-enabled temperature, or the power supply to the center lamp 36 and the side lamp 37 is shut off. When a print instruction is given when the heater roller is in the sleep mode, power is immediately supplied to the center lamp 36, the side lamp 37 or the auxiliary lamp 38 and the heat roller 33 is thus started up to the fixing-enabled temperature.

The CPU 72 saves, in a memory 72*a*, a predetermined low-temperature anomaly determination reference temperature Ta (° C.) (for example, 40° C.) and a predetermined high-temperature anomaly determination reference temperature Tb(° C.) (for example, 230° C.), which are set with reference to the fixing-enabled temperature. The low-temperature anomaly determination reference temperature Ta(° C.) is a threshold value indicating that the center lamp 36 or the side lamp 37 has low-temperature anomaly and for example, causes a fixing failure of the heat roller 33. The high-temperature anomaly determination reference temperature Tb(° C.) is a threshold value indicating that the center lamp 36 or the side lamp 37 has high-temperature anomaly and, for example, the heat of the heat roller 33 affects the periphery. Moreover, the low-temperature anomaly determination reference temperature Ta(° C.) and the high-temperature anomaly determination reference temperature Tb(° C.) are threshold values by which anomaly of the center lamp 36 or the side lamp 37 can be detected even when the auxiliary lamp 38 has low-temperature anomaly or high-temperature anomaly simultaneously with the center lamp 36 or the side lamp 37.

Figure 6:
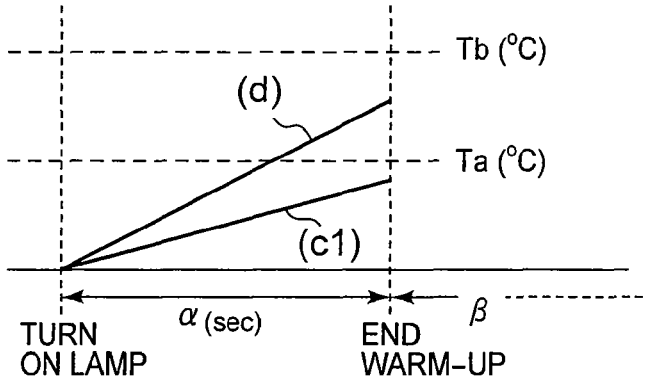
FIG. 6 is a graph showing the temperature characteristics of the heat roller when a center lamp has low-temperature anomaly according to the embodiment.

For example, when the center lamp 36 has low-temperature anomaly, the detected temperature of the heat roller 33 by the center thermistor 40 at the end of warm-up does not reach the low-temperature anomaly determination reference temperature Ta(° C.), as indicated by (c1) in FIG. 6. When the center lamp 36 has low-temperature anomaly during printing or in the ready mode or the like, the detected temperature of the heat roller by the center thermistor 40 falls to or below the low-temperature anomaly determination reference temperature Ta(° C.), as indicated by the dotted line (c') in FIG. 5.

Figure 7:
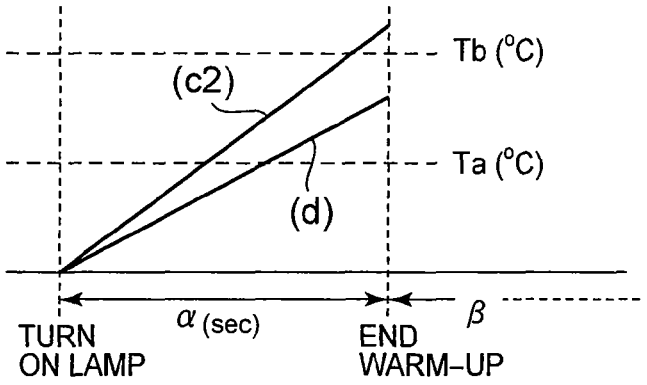
FIG. 7 is a graph showing the temperature characteristics of the heat roller when the center lamp has high-temperature anomaly according to the embodiment.

Meanwhile, when the center lamp 36 has high-temperature anomaly, the detected temperature of the heat roller 33 by the center thermistor 40 at the end of warm-up exceeds the high-temperature anomaly determination reference temperature Tb(° C.), as indicated by (c2) in FIG. 7. When the center lamp 36 has high-temperature anomaly during printing or in the ready mode or the like, the detected temperature of the heat roller 33 by the center thermistor 40 exceeds the high-temperature anomaly determination reference temperature Tb(° C.), as indicated by the chain-dotted line (c") in FIG. 5.

The CPU 72 determines that the center lamp 36 or the side lamp 37 has anomaly, when the temperature of the heat roller 33 is not within the range from the low-temperature anomaly determination reference temperature Ta(° C.) to the high-temperature anomaly determination reference temperature Tb(° C.) as a first predetermined range in accordance with the result of the detection by the center thermistor 40 or the side thermistor 41. When it is determined that the center lamp 36 or the side lamp 37 has anomaly, the CPU 72 displays anomaly on the control panel 77 and stops the copier 10.

However, in the normal temperature control mode, even if the auxiliary lamp 38 having a power consumption that is ½ of the power consumption of the center lamp 36 or the side lamp 37 has anomaly, the center thermistor 40 or the side thermistor 41 cannot detect the anomaly of the auxiliary lamp 38. For example, even if the auxiliary lamp 38 has low-temperature anomaly, the detected temperature of the heat roller 33 by the center thermistor 40 at the end of warm-up is as indicated by the solid line (c3) in FIG. 8 and the detected temperature of the heat roller 33 of the side thermistor 41 is as indicated by the solid line (d3). Both the detected temperatures of the heat roller 33 indicated by (c3) and (d3) are higher than the low-temperature anomaly determination reference temperature Ta(° C.). Therefore, the CPU 72 cannot determine that the auxiliary lamp 38 has low-temperature anomaly.

Figure 8:
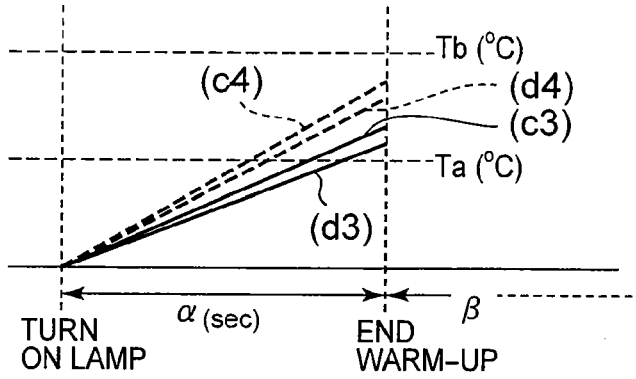
FIG. 8 is a graph showing the temperature characteristics of the heat roller when an auxiliary lamp has anomaly according to the embodiment.

Meanwhile, for example, even if the auxiliary lamp 38 has high-temperature anomaly, the detected temperature of the heat roller 33 by the center thermistor 40 at the end of warm-up is as indicated by the dotted line (c4) in FIG. 8 and the detected temperature of the heat roller 33 by the side thermistor 41 is as indicated by the dotted line (d4). Both the detected temperatures of the heat roller 33 indicated by (c4) and (d4) are below the high-temperature anomaly determination reference temperature Tb(° C.). Therefore, the CPU 72 cannot determine that the auxiliary lamp 38 has high-temperature anomaly.

Moreover, during printing or in the ready mode or the like, the temperature of the heat roller 33 can be maintained within the range from the low-temperature anomaly determination reference temperature Ta(° C.) to the high-temperature anomaly determination reference temperature Tb(° C.) by the center lamp 36 and the side lamp 37 alone, though there is a difference in the heating time. Therefore, even if the auxiliary lamp 38 has anomaly, the CPU 72 cannot determine the anomaly of the auxiliary lamp 38.

Thus, the CPU 72 shifts the fixing device 31 to an anomaly detection mode in order to detect any anomaly of the auxiliary lamp 38. The shift to the anomaly detection mode can be made in any of the following timings except during printing, for example: (1) when the device is in the startup mode; (2) when the device is in the warm-up mode; (3) when image quality maintenance control is performed in the middle of the ready mode; (4) when an inspection instruction is given by the operator from the control panel 77 in the middle of the ready mode; (5) when the copier 10 is restored after a paper jam is removed; (6) when the developer empty state of the toner supply device 19 is detected and a near-empty state is displayed on the control panel 77; and (7) when the device is in a save mode because the power switch 67 is turned off. Thus, it is possible to set the fixing device 31 to shift to the anomaly detection mode in one of the timings in accordance with the control that is more appropriate for the copier 10.

In the anomaly detection mode, only the auxiliary lamp 38 is turned on for a third predetermined time in the state where the center lamp 36 and the side lamp 37 are off. In the anomaly detection mode, it is inspected whether the quantity of temperature change that is generated in the heat roller 33 while only the auxiliary lamp 38 is on for the third predetermined time is within a third predetermined range or not. When the quantity of temperature change in the heat roller 33 when only the auxiliary lamp 38 is on for the third predetermined time is within the third predetermined range, the. CPU 72 determines that the auxiliary lamp 38 is normal. When the quantity of temperature change in the heat roller 33 when only the auxiliary lamp 38 is on for the third predetermined time does not reach the third predetermined range, the CPU 72 determines that the auxiliary lamp 38 has low-temperature anomaly. When the quantity of temperature change in the heat roller 33 when only the auxiliary lamp 38 is on for the third predetermined time exceeds the third predetermined range, the CPU 72 determines that the auxiliary lamp 38 has high-temperature anomaly.

Figure 9:
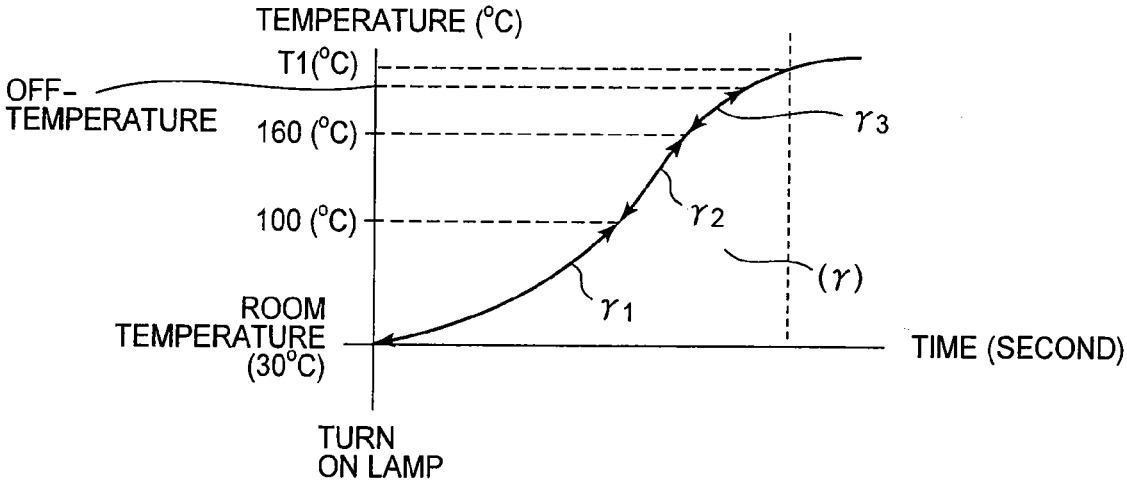
FIG. 9 is a graph showing an example of a temperature rise characteristic of the heat roller according to the embodiment.

However, when the auxiliary lamp 38 operates normally, the quantity of temperature change in the heat roller 33 when only the auxiliary lamp 38 is on for the third predetermined time varies depending on the temperature of the heat roller 33 at the time of starting the anomaly detection mode. For example, FIG. 9 shows the temperature rise characteristic of the heat roller 33 when the center lamp 36, the side lamp 37 and the auxiliary lamp 38 are on. In FIG. 9, the temperature rise characteristic (γ) of the heat roller 33 from the room temperature (for example, 30° C.) to a temperature exceeding a predetermined threshold value T1 that is higher than the off-temperature (for example, 185° C.) is expressed by an S-curve.

In FIG. 9, the temperature rise gradient of the heat roller 33 becomes lower as the temperature of the heat roller 33 exceeds T1. In the area where the temperature of the heat roller 33 exceeds T1(° C.), the quantity of temperature change in the heat roller in the anomaly detection mode is small and it is difficult to determine anomaly of the auxiliary lamp 38. Therefore, when the temperature of the heat roller 33 at the time of starting the anomaly detection mode exceeds T1, the CPU 72 stops the shift to the anomaly detection mode and skips the inspection as to whether the auxiliary lamp 38 is normal or not.

When the temperature of the heat roller 33 becomes T1 (° C.) or lower after that, the CPU 72 can shift to the anomaly detection mode in any of the following timings: (1) when the device is in the startup mode; (2) when the device is in the warm-up mode; (3) when image quality maintenance control is performed in the middle of the ready mode; (4) when an inspection instruction is given by the operator from the control panel 77 in the middle of the ready mode; (5) when the copier 10 is restored after a paper jam is removed; (6) when the developer empty state of the toner supply device 19 is detected and a near-empty state is displayed on the control panel 77; and (7) when the device is in the save mode because the power switch 67 is turned off. Therefore, when the temperature of the heat roller 33 exceeds T1 (° C.), even if the CPU 72 stops the shift to the anomaly detection mode for the auxiliary lamp 38 and skips the inspection as to whether the auxiliary lamp 38 is normal or not, the influence of this operation on the fixing capability at the time of printing can be avoided. The CPU 72 saves T1 (° C.) in the memory 72*a*.

Figure 10:
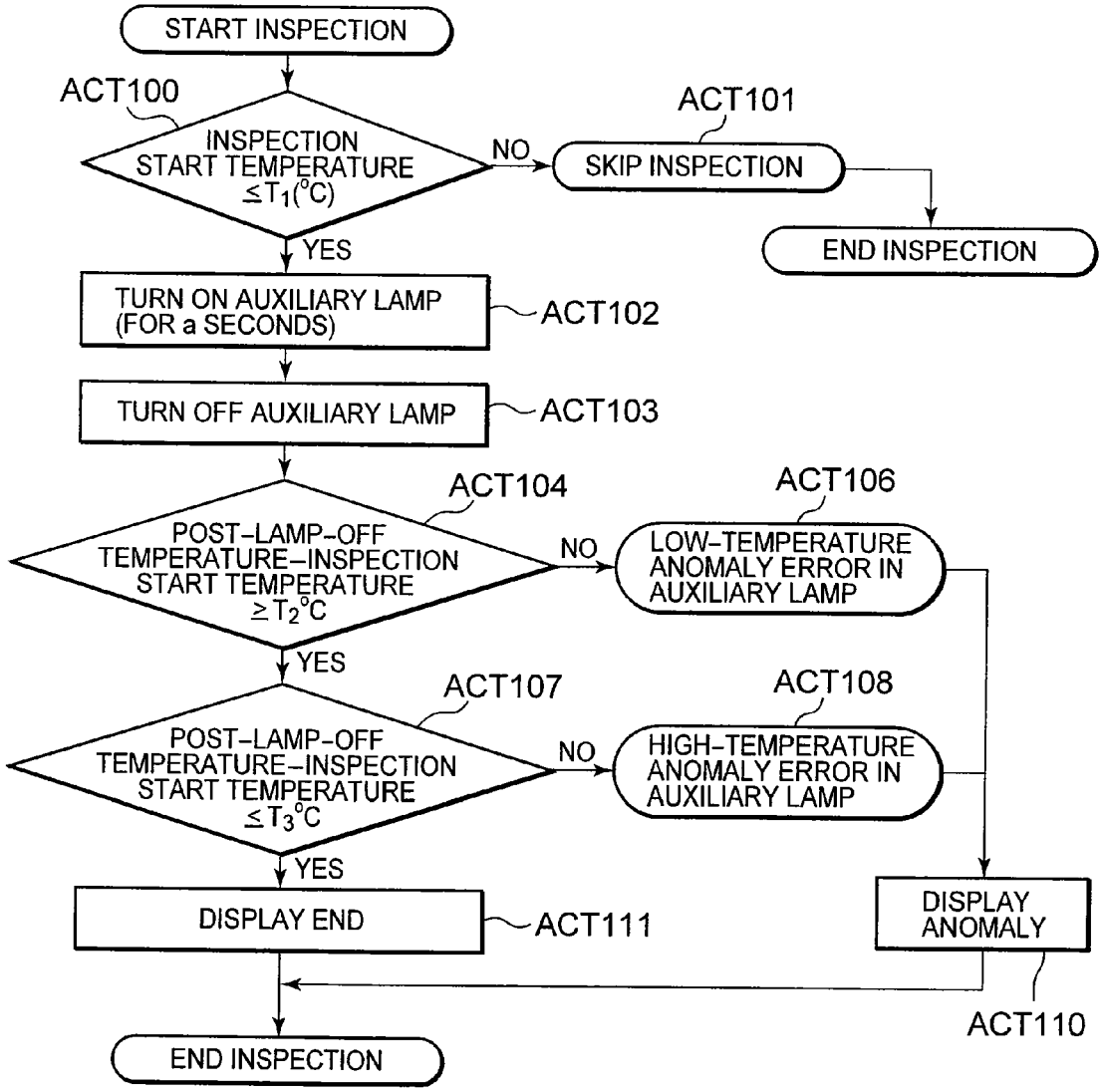
FIG. 10 is a flowchart showing control to inspect anomaly of the auxiliary lamp according to the embodiment.

After shifting to the anomaly detection mode in order to inspect whether the auxiliary lamp 38 is normal or not, the CPU 72 shifts the control of the fixing device 31 to the anomaly detection mode and starts an inspection to detect whether the auxiliary lamp 38, is normal or not, in accordance with the flowchart shown in FIG. 10. When the temperature of the heat roller 33 at the start of the inspection exceeds T1 (° C.) (No in ACT 100), the CPU 72 stops the anomaly detection mode, skips the inspection as to whether the auxiliary lamp 38 is normal or not (ACT 101), and ends the inspection.

Figures 11, 12:
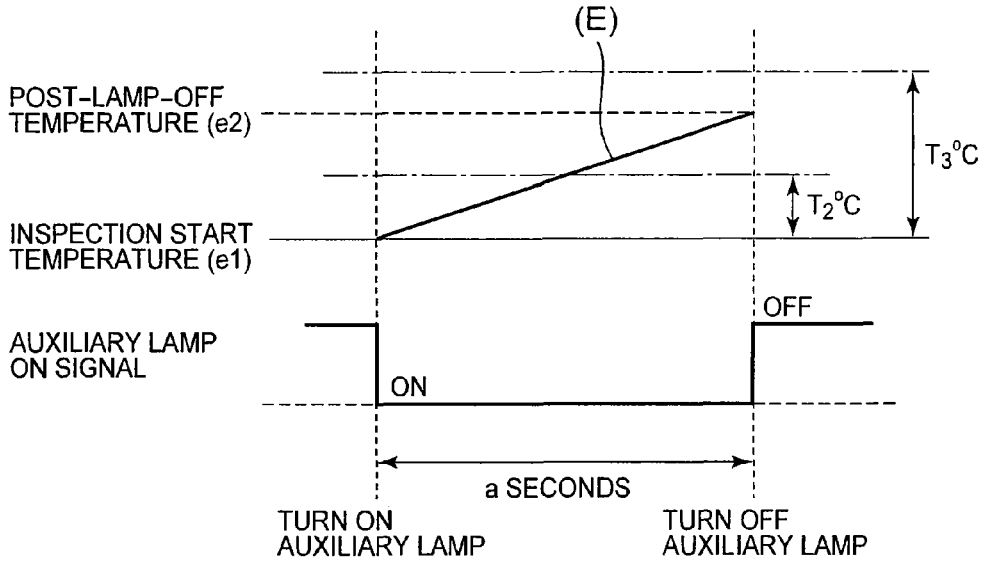
FIG. 11 is a graph showing determination conditions for inspection of anomaly of the auxiliary lamp according to the embodiment.
FIG. 12 is a table showing an example of adjustment of a minimum quantity of change and a maximum quantity of change corresponding to the temperature of the heat roller according to the embodiment.

When the temperature of the heat roller 33 is T1 (° C.) or lower (Yes in ACT 100), the ASIC 74 inputs an off-signal to the center lamp control circuit 61 and the side lamp control circuit 62 and inputs an on-signal to the auxiliary lamp control circuit 63, thus turning on the auxiliary lamp 38 (ACT 102), as shown in FIG. 11. With the lapse of "a" seconds (for example, 10 seconds) as the third predetermined time after the auxiliary lamp 38 is turned on, the auxiliary lamp 38 is turned off (ACT 103). The quantity of temperature change (E) in the heat roller 33 from an inspection start temperature (e1) when the auxiliary lamp 38 is turned on to a post-lamp-off temperature (e2) when the auxiliary lamp 38 is turned off after the lapse of (a) seconds is measured by the center thermistor 40 or the side thermistor 41.

When the quantity of temperature change (E) in the heat roller 33 is a minimum quantity of change T2° C. or greater (Yes in ACT 104), the processing goes to ACT 107. When the quantity of temperature change (E) in the heat roller 33 does not reach the minimum quantity of change T2° C. (No in ACT 104), the CPU 72 determines that the auxiliary lamp 38 has low-temperature anomaly error (ACT 106), then displays the anomaly of the auxiliary lamp 38 on the control panel 77 of the copier 10 (ACT 110), and ends the inspection.

When, in ACT 107, the quantity of temperature change (E) in the heat roller 33 is a maximum quantity of change T3° C. or smaller (Yes in ACT 107), the quantity of temperature change (E) in the heat roller 33 is within the range from the minimum quantity of change T2° C. (for example, 10° C.) to the maximum quantity of change T3° C. (for example, 40° C.), as the third predetermined range. Therefore, the CPU 72 determines that the auxiliary lamp 38 is normal. The CPU 72 displays on the control panel 77 that the auxiliary lamp 38 is normal (ACT 111) and ends the inspection.

When, in ACT 107, the quantity of temperature change (E) in the heat roller 33 exceeds the maximum quantity of change T3° C. (No in ACT 107), the CPU 72 determines that the auxiliary lamp 38 has high-temperature anomaly error (ACT 108). The CPU 72 displays the anomaly of the auxiliary lamp 38 on the control panel 77 (ACT 110) and ends the inspection. As the operator recognizes that display showing that the auxiliary lamp 38 has anomaly, for example, the operator requests the maintenance or replacement of the auxiliary lamp 38 the next time the operator calls a maintenance service worker next time. The CPU 72 saves the minimum quantity of change T2° C. and the maximum quantity of change T3° C. in the memory 72*a*.

However, the range from the minimum quantity of change T2° C. (for example, 10° C.) to the maximum quantity of change T3° C. (for example, 40° C.), as the third predetermined range, shown in FIG. 11, varies in accordance with the temperature of the heat roller 33 at the start of the inspection when the CPU 72 shifts to the anomaly detection mode. The temperature rise characteristic of the heat roller 33 shown in FIG. 9 are roughly divided into three areas, that is, a temperature rise characteristic γ1 where the temperature of the heat roller 33 is the room temperature to 100(° C.), a temperature rise characteristic γ2 where the temperature of the heat roller 33 is 100(° C.) to 160(° C.), and a temperature rise characteristic γ3 where the temperature of the heat roller 33 is 160(° C.) to the off-temperature.

The slope of the temperature rise characteristic is greater in the area of the temperature rise characteristic γ2 than in the areas of the temperature rise characteristic γ1 and the temperature rise characteristic γ3. Therefore, the quantity of temperature change (E) when the auxiliary lamp 38 is on for (a) seconds is different between when the inspection start temperature (e1) of the heat roller 33 at the start of the anomaly detection mode is in the area of the temperature rise characteristic γ1 or the temperature rise characteristic γ3 and when the inspection start temperature is in the area of the temperature rise characteristic γ2.

When the minimum quantity of change T2° C. and the maximum quantity of change T3° C. are specified, when anomaly is detected in the area of the temperature rise characteristic γ1 or the temperature rise characteristic γ3 where the slope is gentle, the quantity of temperature change (E) may not reach the minimum quantity of change T2° C., depending on the influence of the environment or the like, despite that the auxiliary lamp 38 is normal. When the quantity of temperature change (E) does not reach the minimum quantity of change T2° C., the CPU 72 may erroneously determine that the auxiliary lamp 38 has low-temperature anomaly, though the auxiliary lamp 38 is normal. On the other hand, when anomaly is detected in the area of the temperature rise characteristic γ2 where the slope is sharp, the quantity of temperature change (E) may exceed the maximum quantity of change T3° C., depending on the influence of the environment or the like, despite that the auxiliary lamp 38 is normal. When the quantity of temperature change (E) exceeds the maximum quantity of change T3° C., the CPU 72 may erroneously determine that the auxiliary lamp 38 has high-temperature anomaly, though the auxiliary lamp 38 is normal.

In order to avoid such determination errors, the minimum quantity of change T2° C. or the maximum quantity of change T3° C. can be adjusted in accordance with the temperature (e1) of the heat roller 33 at the start of the inspection. Thus, higher inspection accuracy can be achieved when the device in the anomaly detection mode.

For example, when the inspection start temperature (e1) of the heat roller 33 is in the area of the temperature rise characteristic γ1 or the temperature rise characteristic γ3, the minimum quantity of change T2° C. may be 5° C. and the maximum quantity of change T3° C. may be 35° C., as shown in FIG. 12. The range of the quantity of temperature change (E) is shifted below, compared to when the inspection start temperature (e1) of the heat roller 33 is in the area of the temperature rise characteristic γ2. Even if the quantity of temperature change (E) of the heat roller 33 during (a) seconds is small where the inspection start temperature (e1) of the heat roller 33 is in the area of the temperature rise characteristic γ1 or the temperature rise characteristic γ3, determination errors can be prevented since the minimum quantity of change T2° C. is shifted below.

When anomaly of the auxiliary lamp 38 is detected via the anomaly detection mode, the CPU 72 displays the anomaly on the control panel 77, thus prompts the user to do maintenance, and then shifts to the ready mode.

When the copier 10 is not currently performing printing, it is possible to inspect whether the auxiliary lamp 38 is normal or not via the anomaly detection mode without having any constraint on the temperature of the heat roller 33. Therefore, the CPU 72 may set the device not to perform the anomaly detection mode when the device is in the startup mode or in the warm-up mode, so that the ready-state can be reached in earlier timing after the power switch is turned on. In this case, for example, the CPU 72 may set the device to inspect the auxiliary lamp 38 via the anomaly detection mode only when the device is in the save mode as the power switch 67 is turned off.

The CPU 72 may set the device to inspect whether the center lamp 36, the side lamp 37 and the auxiliary lamp 38 are normal or not, for example, when the device is in the warm-up mode, and thus detect anomaly of the fixing device 31. In this case, the CPU 72 sets the device to turn on the auxiliary lamp 38 first and inspect the auxiliary lamp 38 via the anomaly detection mode, without immediately turning on the center lamp 36 and the side lamp 37 even when the warm-up mode is started. The CPU 72 sets the device to turn on the center lamp 36 and the side lamp 37 after the anomaly detection mode is finished, and thus inspect whether the center lamp 36 or the side lamp 37 is normal or not on the basis of the temperature of the heat roller 33 at the end of the warm-up.

When the center lamp 36, the side lamp 37 and the auxiliary lamp 38 are normal, the fixing device 31 shifts to the ready mode when the warm-up ends. When the center lamp 36 or the side lamp 37 has anomaly, the CPU 72 displays the anomaly on the control panel 77 and stops the copier 10. When the auxiliary lamp 38 has anomaly, the CPU 72 displays the anomaly on the control panel 77, thus prompts the user to do maintenance, and then shifts to the ready mode.

Alternatively, an empty state of the developer is detected in the toner supply device 19 and the inspection as to whether the auxiliary lamp 38 is normal or not via the anomaly detection mode is carried out when a near-empty state is displayed on the control panel 77. Thus, when the auxiliary lamp 38 has anomaly, it is possible to request replacement of the auxiliary lamp when calling a maintenance service worker for toner supply.

According to this embodiment, the fixing device 31 can shift to the anomaly detection mode in arbitrary timing except during printing. In the anomaly detection mode, the center lamp 36 and the side lamp 37 are off and only the auxiliary lamp 38 is turned on for a predetermined time. The quantity of temperature change in the heat roller 33 during that time is detected by the center thermistor 40 or the side thermistor 41. When the quantity of temperature change is within a predetermined range, it is determined that the auxiliary lamp 38 is normal. In inspecting whether the auxiliary lamp 38 is normal or not, when the temperature of the heat roller 33 is in the area exceeding T1° C. where the temperature rise gradient of the heat roller 33 is gentler, the inspection as to whether the auxiliary lamp 38 is normal or not is skipped. Thus, since the area where determination of anomaly of the auxiliary lamp 38 is difficult is avoided in the inspection, determination errors as to whether the auxiliary lamp 38 is normal or not can be avoided. At the time of inspecting whether the auxiliary lamp 38 is normal or not, the range of the quantity of temperature change in the heat roller 33 during a predetermined time when only the auxiliary lamp 38 is on is adjusted in accordance with the slope of the temperature rise characteristic of the heat roller 33. As the range of the quantity of temperature change in the heat roller 33 is varied in accordance with the inspection start temperature (e1) of the heat roller 33, the CPU 72 can be prevented from making a determination error as to whether the auxiliary lamp 38 is normal or not.

The invention is not limited to the above embodiment and various changes and modifications can be made without departing from the scope of the invention. For example, the heat generation peak positions of the first heating member and the second heating member are not limited as long as their heat generation peak positions are different from each other. The power consumptions of the first heating member, the second heating member and the third heating member are not limited. The fixing-enabled temperature and the temperature rise characteristic of the fixing member are arbitrary as well. Moreover, the third predetermined time or the third predetermined range can be adjusted in accordance with the characteristics of the fixing member. The timing of detecting the quantity of temperature change in the fixing member where only the third heating member is on for a predetermined time is not limited. For example, other than detecting this timing when the device is in the save mode, the device can also be set to detect the above timing only when an instruction is inputted by the operator through the control panel or the like according to needs. Moreover, the fixing member may be in the shape of an endless belt.

What is claimed is:

1. A fixing device comprising:

a fixing member which fixes a developer image to a recording medium;

a first heat generation member which heats the fixing member;

a second heat generation member which has a different heat generation peak position from a heat generation peak of the first heat generation member in a direction of a rotation axis of the fixing member and heats the fixing member;

a third heat generation member which heats the fixing member overlap for the heat generation peak positions of the first heat generation member and the second heat generation member;

a first temperature detection member provided near the heat generation peak position of the first heat generation member;

a second temperature detection member provided near the heat generation peak position of the second heat generation member;

a circuit member which performs on-off control of the first heat generation member, the second heat generation member and the third heat generation member; and an anomaly detection member which turns off the first heat generation member and the second heat generation member, turns on only the third heat generation member for a third predetermined time, detects a quantity of temperature change in the fixing member during a lapse of the third predetermined time after only the third heat generation member starts being on, by using the first temperature detection member or the second temperature detection member, and inspects whether the quantity of temperature change is within a third predetermined range or not.

2. The device according to claim 1, wherein power consumption of the third heat generation member is smaller than power consumption of the first heat generation member and the second heat generation member.

3. The device according to claim 2, wherein the anomaly detection member skips inspection as to whether the quantity of temperature change is within the third predetermined range or not, when the detected temperature by the first temperature detection member or the second temperature detection member is equal to or higher than a predetermined threshold value that is higher than an off-temperature of the fixing member.

4. The device according to claim 1, wherein after inspecting whether the third heat generation member is normal or not, the anomaly detection member turns on the first heat generation member and the second heat generation member and inspects whether a result of detection by the first temperature detection member and the second temperature detection member after the lapse of a first predetermined time is within a first predetermined range or not.

5. The device according to claim 1, wherein the third predetermined range varies in accordance with a temperature of the fixing member when only the third heat generation member starts being on.

6. The device according to claim 5, wherein the third predetermined range varies in accordance with a temperature rise characteristic of the fixing member, and when the temperature rise characteristic of the fixing member when only the third heat generation member starts being on has a sharp slope, the third predetermined range is set to be higher.

7. An image forming apparatus comprising:

an image carrier member;

an image forming member which forms a developer image on the image carrier member;

a transfer member which transfers the developer image to a recording medium;

a fixing member which fixes the developer image to the recording medium;

a first heat generation member which heats the fixing member;

a second heat generation member which has a different heat generation peak position from a heat generation peak of the first heat generation member in a direction of a rotation axis of the fixing member and heats the fixing member;

a third heat generation member which heats the fixing member overlap for the heat generation peak positions of the first heat generation member and the second heat generation member;

a first temperature detection member provided near the heat generation peak position of the first heat generation member;

a second temperature detection member provided near the heat generation peak position of the second heat generation member;

a circuit member which performs on-off control of the first heat generation member, the second heat generation member and the third heat generation member; and an anomaly detection member which turns off the first heat generation member and the second heat generation member, turns on only the third heat generation member for a third predetermined time, detects a quantity of temperature change in the fixing member during the lapse of the third predetermined time after only the third heat generation member starts being on, by using the first temperature detection member or the second temperature detection member, and inspects whether the quantity of temperature change is within a third predetermined range or not.

8. The apparatus according to claim 7, wherein power consumption of the third heat generation member is smaller than power consumption of the first heat generation member and the second heat generation member.

9. The apparatus according to claim 8, wherein the anomaly detection member skips inspection as to whether the quantity of temperature change is within the third predetermined range or not, when the detected temperature by the first temperature detection member or the second temperature detection member is equal to or higher than a predetermined threshold value that is higher than an off-temperature of the fixing member.

10. The apparatus according to claim 7, wherein after inspecting whether the third heat generation member is normal or not, the anomaly detection member turns on the first heat generation member and the second heat generation member and inspects whether a result of detection by the first temperature detection member and the second temperature detection member after the lapse of a first predetermined time is within a first predetermined range or not.

11. The apparatus according to claim 7, wherein the third predetermined range varies in accordance with a temperature of the fixing member when only the third heat generation member starts being on.

12. The apparatus according to claim 11, wherein the third predetermined range varies in accordance with a temperature rise characteristic of the fixing member, and when the temperature rise characteristic of the fixing member when only the third heat generation member starts being on has a sharp slope, the third predetermined range is set to be higher.

13. The apparatus according to claim 7, wherein at the time of image quality maintenance control in the image forming apparatus, the anomaly detection member turns off the first heat generation member and the second heat generation member, turns on only the third heat generation member for the third predetermined time, detects the quantity of temperature change in the fixing member during the lapse of the third predetermined time after only the third heat generation member starts being on, by using the first temperature detection member or the second temperature detection member, and inspects whether the quantity of temperature change is within the third predetermined range or not.

14. The apparatus according to claim 7, wherein when an empty state of the developer is detected, the anomaly detection member turns off the first heat generation member and the second heat generation member, turns on only the third heat generation member for the third predetermined time, detects the quantity of temperature change in the fixing member during the lapse of the third predetermined time after only the third heat generation member starts being on, by using the first temperature detection member or the second temperature detection member, and inspects whether the quantity of temperature change is within the third predetermined range or not.

15. The apparatus according to claim 7, wherein when power of the image forming apparatus is off, the anomaly detection member turns off the first heat generation member and the second heat generation member, turns on only the third heat generation member for the third predetermined time, detects the quantity of temperature change in the fixing member during the lapse of the third predetermined time after only the third heat generation member starts being on, by using the first temperature detection member or the second temperature detection member, and inspects whether the quantity of temperature change is within the third predetermined range or not.

16. The apparatus according to claim 7, wherein when an inspection instruction is inputted by an operator, the anomaly detection member turns off the first heat generation member and the second heat generation member, turns on only the third heat generation member for the third predetermined time, detects the quantity of temperature change in the fixing member during the lapse of the third predetermined time after only the third heat generation member starts being on, by using the first temperature detection member or the second temperature detection member, and inspects whether the quantity of temperature change is within the third predetermined range or not.

17. An anomaly detection method for a fixing device comprising:

turning off a first heat generation member and a second heat generation member which have different heat generation peak positions from each other in a direction of a rotation axis of a fixing member;

turning on only a third heat generation member which heats the fixing member overlap for at the heat generation peak positions of the first heat generation member and the second heat generation member, for a third predetermined time while the first heat generation member and the second heat generation member are off;

detecting a quantity of temperature change in the fixing member during the lapse of the third predetermined time after only the third heat generation member starts being on, by using a first temperature detection member which detects a heating temperature of the fixing member by the first heat generation member or a second temperature detection member which detects a heating temperature of the fixing member by the second heat generation member; and inspecting whether the quantity of temperature change is within a third predetermined range or not.

18. The method according to claim 17, wherein when the detected temperature by the first temperature detection member or the second temperature detection member is lower than a predetermined threshold value that is higher than an off-temperature of the fixing member, the inspection as to whether the quantity of temperature change is within the third predetermined range or not is carried out.

19. The method according to claim 17, wherein after the inspection as to whether the quantity of temperature change is within the third predetermined range or not is carried out, the first heat generation member and the second heat generation member are turned on and it is inspected whether a result of detection by the first temperature detection member and the second temperature detection member after the lapse of a first predetermined time is within a first predetermined range or not.

* * * * *